US010982666B2

(12) United States Patent
Winking et al.

(10) Patent No.: US 10,982,666 B2
(45) Date of Patent: Apr. 20, 2021

(54) FLUID PUMP

(71) Applicant: B. BRAUN AVITUM AG, Melsungen (DE)

(72) Inventors: Philipp Winking, Osnabrück (DE); Oliver Schäfer, Neuenstein (DE); Andreas Iske, Söhrewald (DE)

(73) Assignee: B. BRAUN AVITUM AG, Melsungen (DE)

( * ) Notice: Subject to any disclaimer, the term of this patent is extended or adjusted under 35 U.S.C. 154(b) by 344 days.

(21) Appl. No.: 15/902,164

(22) Filed: Feb. 22, 2018

(65) Prior Publication Data

US 2018/0245578 A1 Aug. 30, 2018

(30) Foreign Application Priority Data

Feb. 24, 2017 (DE) ..... 10 2017 103 857.4

(51) Int. Cl.
*F04B 43/12* (2006.01)

(52) U.S. Cl.
CPC ..... *F04B 43/1276* (2013.01); *F04B 43/1253* (2013.01)

(58) Field of Classification Search
CPC ..... F04B 43/1276; F04B 43/1253; F04B 43/1284; F04B 43/1261; F04B 43/1269
See application file for complete search history.

(56) References Cited

U.S. PATENT DOCUMENTS 2,804,023 A * 8/1957 Lee ..... F04B 43/1276 417/477.7
3,447,478 A * 6/1969 Clemens ..... F04B 43/1284 417/477.8
3,644,068 A 2/1972 Lepak
3,885,894 A * 5/1975 Sikes ..... F04B 43/1253 417/477.1
4,299,218 A 11/1981 Knigge et al.
4,568,255 A * 2/1986 Lavender ..... F04B 43/1276 417/477.8

(Continued)

FOREIGN PATENT DOCUMENTS

DE 2852041 A1 6/1979
DE 8111484 U1 11/1981

(Continued)

OTHER PUBLICATIONS

German Search Report for German Application No. 10 2017 103 857.4, with translation, dated Aug. 18, 2017, 13 pages.

(Continued)

*Primary Examiner* — Nathan C Zollinger

(57) ABSTRACT

An occlusive peristaltic pump type fluid pump that includes a pump rotor rotatable in the fluid pump. The fluid pump includes a base, a first cover element fastened to an upper side of the base and a second cover element fastened to a lower side of the base, and at least one pressure element accommodated in the base and including a pressure member for occluding a fluid-guiding hollow conductor portion against a rounded bearing surface on a housing portion of the fluid pump. The at least one pressure element is linearly guided in the effective direction of an occlusion force by the first cover element and the second cover element.

10 Claims, 4 Drawing Sheets

(56) References Cited

U.S. PATENT DOCUMENTS

| | | | | |
|---|---|---|---|---|
| 2002/0173755 | A1* | 11/2002 | Christenson | A61M 5/14232 604/288.04 |
| 2013/0126404 | A1* | 5/2013 | Gronau | F04B 49/022 210/97 |
| 2016/0000988 | A1* | 1/2016 | Fini | A61M 1/367 137/565.01 |
| 2016/0082168 | A1 | 3/2016 | Zhu et al. | |

FOREIGN PATENT DOCUMENTS

| | | | |
|---|---|---|---|
| DE | 8429975 | U1 | 2/1985 |
| DE | 102010033241 | A1 | 2/2012 |
| DE | 102015115779 | A1 | 3/2016 |
| JP | 07217541 | A | 8/1995 |

OTHER PUBLICATIONS

European Search Report for European Application No. 18158138.0, dated Jul. 6, 2018 with translation, 11 pages.

* cited by examiner

FLUID PUMP

CROSS REFERENCE TO RELATED APPLICATIONS

This application claims priority to German application DE 10 2017 103 857.4 filed Feb. 24, 2017, the contents of such application being incorporated by reference herein.

FIELD OF THE INVENTION

The invention relates to a fluid pump and especially relates to an occlusive peristaltic pump for conveying blood, sterile dialysate, 0.9% saline solution and the like, generally also drugs and/or fluids to be pumped within the scope of extracorporeal blood treatment, wherein a fluid-conveying tube occludes by a spring-loaded roller against a rounded bearing surface.

BACKGROUND OF THE INVENTION

The function of a peristaltic pump is generally based on pressure and relief which alternately act on a hollow conductor such as a tube or a pipe.

At least one rotating element, for example in the form of a shoe or a roller, cyclically runs along a predetermined section of the hollow conductor while exerting pressure on the hollow conductor so that the degree of opening thereof is decreased and a sealing effect is generated between the suction side and discharge side of the pump. Without the action of pressure, i.e. after the rotating element has passed the predetermined section of the hollow conductor, the hollow conductor returns to its original state and a vacuum is formed which sucks content provided in the hollow conductor into the hollow conductor and draws a substance to be pumped into the pump. Frequently, for this purpose rotating elements are arranged to be offset against each other and to be revolving for a low-pulsation volume flow and lower mechanical load of the hollow conductor.

Known occlusive peristaltic pumps are those, for example, in which at least one roller is loaded with force by a spring attached to a rocker. The rocker is attached to a base with an additional bolt and is movably arranged as a lever. The bearing of the roller is located within the rocker. The spring is located level with the roller or further behind the roller. Force is transmitted by form closure or force closure, wherein the force transmission may start without changing the grip and, respectively, automatic alignment may take place upon the start of force transmission. Bayonet locks without self-centering including a separate flap or including a non-suspended cap may be provided.

It is especially a drawback of the known arrangements that the roller for occluding the tube is loaded with spring force via an articulated rocker as a lever, wherefrom an increased number of parts required, a higher machining expenditure and increased assembly costs are resulting.

SUMMARY OF THE INVENTION

Therefore, an object underlying the invention is to provide a pump of the afore-mentioned type in which a resilient bearing of at least the pressure roller can be realized at low cost without any deterioration of the therapeutic result.

In accordance with the invention, an object is achieved by an apparatus comprising the features of the independent claim. Advantageous developments of the invention are the subject matter of the enclosed dependent claims.

In conformity with a general inventive idea, in an occlusive peristaltic pump a linear guiding which does not require any additional bearings is arranged instead of a rocker for example in at least one housing portion, such as in a cover portion and/or a bottom portion of the housing of a pump rotor. A spring provided for pressure build-up for occlusion is arranged directly behind the pressure roller. An angle of the linear guiding is defined by determining the direction of force and the magnitude of force for occluding the tube.

The linear guiding of the rocker is attached in the direction of the occlusion force to be applied, with the angle of the linear guiding preferably ranging from 35° to 55° and an optimum being expected at 42°. This angle is located between an occlusion point of the tube and a stop or bearing point of a drive shaft of the pump. The linear guiding may be beveled for compensating a draw, for example, of a radius of a peripheral wall. The additional force component by beveling may be absorbed by the bearing inside a gear unit. In order to minimize wear on the linear guiding, the latter may be designed as a (e.g. swallow tailed) profile, for example. Alternatively, a straight contact of the rocker with a cover and/or bottom may be configured to be tilted so as to reduce a friction period and thus wear as well as jamming. Preferably, for this purpose friction-optimized material combinations, i.e. those having a low friction coefficient, are used which do not promote any jamming. For example, a combination of PBT (polybutylene terephthalate) with PBT may be provided, or a combination of PBT with PI (polyimide)+graphite+PTFE (polytetrafluoroethylene) may be used as an insert or molded piece into the guiding.

Preferably, at least one roller is externally supported so that no spacers are required and bearings are retained from outside via press fit. The rocker itself is preferably manufactured by plastic injection molding and the bearing is fixed in the rocker again via press fit. Preferably, covers (identical parts for the upper and lower sides) are retained to the rocker by cylindrical pins.

The spring is preferably fastened behind the rocker, is secured by a cylindrical pin and is damped by silicone at the ends of a (small) cylindrical pin. The component consisting of the spring and the rocker can be preassembled and thus can be checked prior to mounting for complying with a predetermined spring force, for example.

A base may be reinforced by a sheet metal part for improved retaining of the occlusion force to passages for the rocker. In this case, a sheet metal-side recess may enable assembly via a bayonet lock which can be secured after 90° rotation by the spring force in bias.

Both rockers may be (pre)assembled in the base in this way. Preferably, preassembly is carried out from the bottom side by inserting the magnets. Preassembly of the cover by inserting the cap for force transmission, preferably including suspension, is possible. A suspension for releasing the form closure when pressing the respective locking plate may be provided. Centering of the pump rotor is realized by a profile formed in the bottom of the pump rotor and a corresponding profile on the drive shaft. The rockers can be secured by attaching the cover and the bottom.

A bearing surface may be separable to enable better machining of the bottom and/or the cover in terms of production, thus enabling the use of raw material similar to the final geometry. A bottom plate simultaneously serves as cover of a gearing portion receiving a gear unit. In this area, a fit may be provided preferably via tapered pins and a fixation by screws may be provided, wherefrom a smaller number of geometric tolerances with respect to the tolerance of the occlusion point is resulting and larger tolerances can be compensated. The bearing surface may be configured together with the bottom plate by injection molding, wherein the draw may be compensated by the pump rotor or the draw may be removed by refinishing in this case. Equally, the rear side of the bottom of the pump may be used as gear unit cover.

A cover plate attached to the outside may be designed for functional differences (use of a multi-connector or a predetermined tubing set).

Embodiments according to aspects of the invention thus advantageously include fewer parts, can be assembled more easily and can be manufactured at low cost.

In detail, the object is achieved by an occlusive peristaltic pump-type fluid pump comprising: a pump rotor being rotatable within the fluid pump consisting of a base, a first cover element fastened to the upper side of the base and a second cover element fastened to the lower side of the base; and at least one pressure element accommodated in the base having a pressure member for occlusion of a fluid-guiding hollow conductor portion against a rounded bearing surface on a housing portion of the fluid pump, wherein the at least one pressure element is linearly guided by the first cover element and the second cover element in the effective direction of an occlusion force.

Preferably, each of the first and second cover elements include at least one first projection protruding from the base in the effective direction of the occlusion force, the at least one pressure element includes recesses on the outside of the housing which as to position correspond to the at least one first projection at each of the first and second cover elements; and in the state of the pressure element accommodated in the base, the first projections at the first and second cover elements engage in the recesses of the pressure element on the outside of the housing and form a linear guiding of the pressure element.

Of preference, an angle of the linear guiding formed between an occlusion point of the hollow conductor and a stop of a drive shaft of a drive for rotating the pump rotor is defined by the direction of force and the force magnitude for occlusion of the hollow conductor and preferably ranges from 35° to 55°, optimally amounts to 42°.

Preferably, the linear guiding is beveled for compensating a draw and/or for reducing a friction period and/or a susceptibility to jamming and/or the linear guiding is designed to have a predetermined profile so as to reduce wear.

Preferably, the linear guiding is produced using friction-optimized material combinations, with the material combinations preferably being PBT with PBT or PBT with PI+graphite+PTFE, configured as an insert into the linear guiding.

Preferably, at least the first or second cover element includes at least a second projection protruding from the base outside the effective direction of the occlusion force and in the direction of rotation ahead of the pressure element, wherein the second projection is arranged for holding down a hollow conductor portion subsequently occluded by the pressure element level with the pressure member.

Preferably, the pressure member is a roller-shaped member of preferably metal which is externally supported free from spacers in the pressure element with press fits held at the outer end side.

Preferably, the pressure member is spring-loaded so that a spring encloses a rear housing extension and is secured in the housing extension by a pin-shaped securing means against falling out, with the spring preferably being a pressure spring.

Of preference, the base includes at least one passage for at least one pressure element and in the at least one passage includes a reinforcing element, wherein the reinforcing element is ring-shaped including a recess forming, when operatively connected to the pin-shaped securing means, a bayonet lock to which the pressure element can be secured by passing the pin-shaped securing means through the recess and then rotating the pressure element together with the securing means by 90° in the bias of the spring by the spring force in the bias.

Of preference, the second lower-side cover element is configured to accommodate magnets capable of being preassembled and to provide a centering of the pump rotor by an incorporated profile corresponding to a profile on a drive shaft; the first upper-side cover element is configured to accommodate, by preassembly, a cap element for force transmission from a drive shaft and at least one spring bearing against the base and/or the second cover element; between the base and the first cover element an operable securing element is arranged which is configured to release, when being actuated, a form closure between the base and the first cover element spring-loaded by the spring; and the first and second cover elements are configured to secure the at least one pressure member in the state fixedly attached to the base.

Of preference, the base and the first and second cover elements are made from injection-moldable plastic; and a housing of the fluid pump includes a first housing part having a portion in which the rounded bearing surface is formed and at least a second housing part which comprises a bottom plate mechanically connectable to the first housing part which bottom plate is configured on the rear side as a motor cover and/or gear unit cover, wherein the first housing part and the at least one second housing part are made from machinable material; or the first housing part and the at least one second housing part are made from injection-moldable plastic.

BRIEF DESCRIPTION OF THE DRAWINGS

The invention is best understood from the following detailed description when read in connection with the accompanying drawings. Included in the drawings are the following figures.

DETAILED DESCRIPTION OF THE PREFERRED EMBODIMENTS

Hereinafter, with reference to the schematic diagram of FIGS. 1 and 6, at first a basic structure of an occlusive peristaltic pump type fluid pump is described which may be arranged, for example, as a blood pump for extracorporeal blood treatment in or on an apparatus for extracorporeal blood treatment such as a dialysis machine, without being limited thereto.

Figure 1:
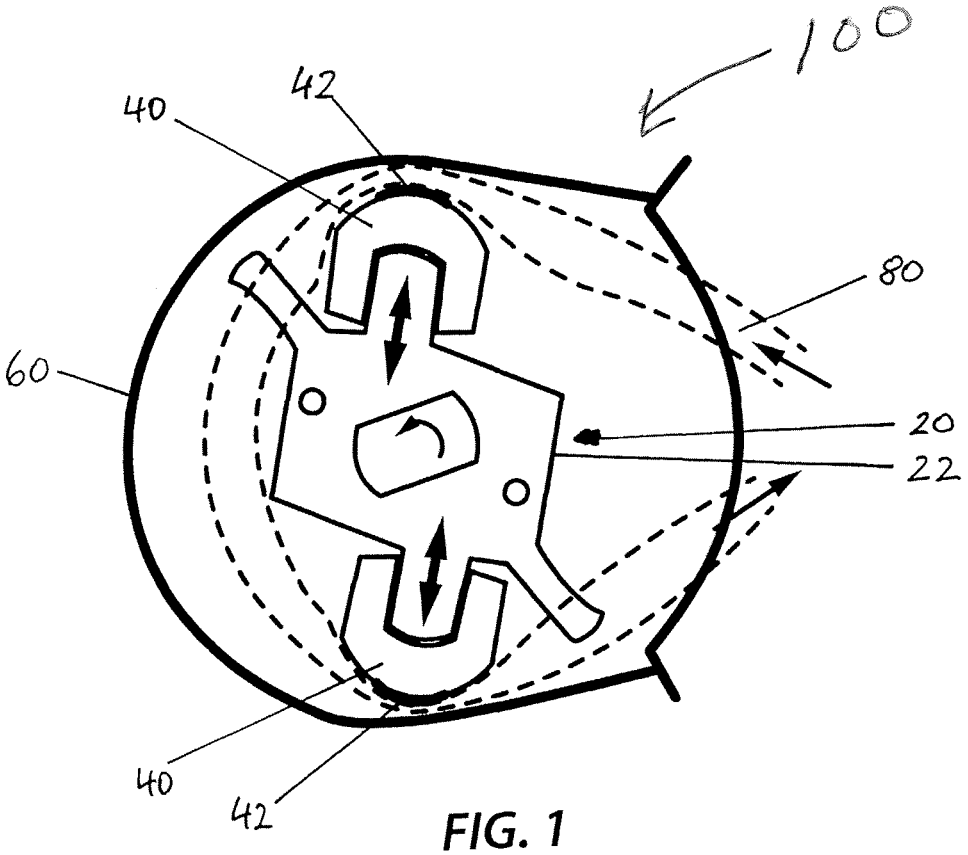
FIG. 1 shows a schematic diagram of a fluid pump operating according to the principle of an occlusive peristaltic pump in an opened top view including a mounted pump rotor, two linearly guided pressure elements, a rounded bearing surface (pump bed) and an inserted hollow conductor (tube) according to aspects of an embodiment.

FIG. 1 illustrates a schematic diagram of a fluid pump 100 in an opened top view comprising a mounted pump rotor 20, two linearly guided pressure elements 40 as such having an identical structure, a rounded bearing surface (pump bed) 60 and an inserted hollow conductor (tube) 80 (represented in broken lines) according to one embodiment.

The fluid pump 100 according to aspects of the embodiment consists at least of the pump rotor 20 to be mounted in a housing of the fluid pump 100 to which pump rotor 20 usually a predetermined number of pressure elements 40 (i.e. at least one pressure element and in the present embodiment two pressure elements) movable with respect to a base (central part) 30, which forms part or a central part of the multi-part pump rotor 20, is assembled.

A pressure element 40 may also be referred to as occlusion element, as it applies a hollow conductor closing force or occlusion force of a predetermined direction and magnitude to the hollow conductor 80 and, in this way, at the hollow conductor 80 generates a local constriction and/or closing point (occlusion) migrating along with the revolving movement of the pressure element 40 occurring during rotation of the pump rotor 20.

Exposed toward the bearing surface 60 of the housing rounded at least in portion, a pressure member 42, such as a (pressure) roller made preferably from metal, is arranged on each pressure element 40 so as to be fixed and rotatable about a coaxially extending central axis of the same. The pressure element 40 bears on the base 30 via a spring 45 which also generates the pressure against the hollow conductor 80. The circumferential surface or shell of the pressure member 42 is arranged so as to bear against the hollow conductor 80, for example a tube.

The pump rotor 20 is structured so that it can be preassembled of several parts and basically consists of the base 30 (not shown in FIG. 1) as well as an upper-side first cover element 22 and a lower-side second cover element 24 mounted thereon (not shown in FIG. 1) and as such can be inserted in the housing of the fluid pump 100 comprising on the inside the rounded bearing surface 60 against which the pressure members (pressure rollers) 40 are bearing with the hollow conductor (tube) 80 being interposed and, where needed, comprising further housing portions for e.g. a gear unit (not shown) and a drive or motor (not shown). The pump rotor 20 can furthermore be driven inside the housing via a drive shaft that is non-positively coupled via the gear unit and/or a drive motor for rotation of the pump rotor 20.

Internal parts such as e.g. the pressure element 40, the base 30, the cover elements 22, 24 and the like (and consequently the pump rotor 20) may be manufactured by plastic injection molding, for example, to obtain an advantageous weight, whereas the housing or pump housing may be made from a machinable metal and each pressure member 42, the spring 45, securing and/or retaining parts such as e.g. cylindrical pins 46 and/or components reinforcing or stiffening the plastic injection mold such as reinforcing plates 32 may equally be made from a metal, or alternatively the housing or pump housing may be made from injection-moldable plastic material and each pressure member 42, the spring 45, securing and/or retaining parts such as e.g. cylindrical pins 46 and/or components reinforcing or stiffening the plastic injection mold, such as e.g. reinforcing plates 32, may in turn by made from a metal.

In the following, with reference to FIG. 2 and FIG. 6, the structure of the pump rotor 20 will be described in detail. For reasons of clarity and symmetry, in FIG. 6 like parts which are evidently shown several times and are identical as such are not repeatedly denoted with like reference numerals.

Figure 2:
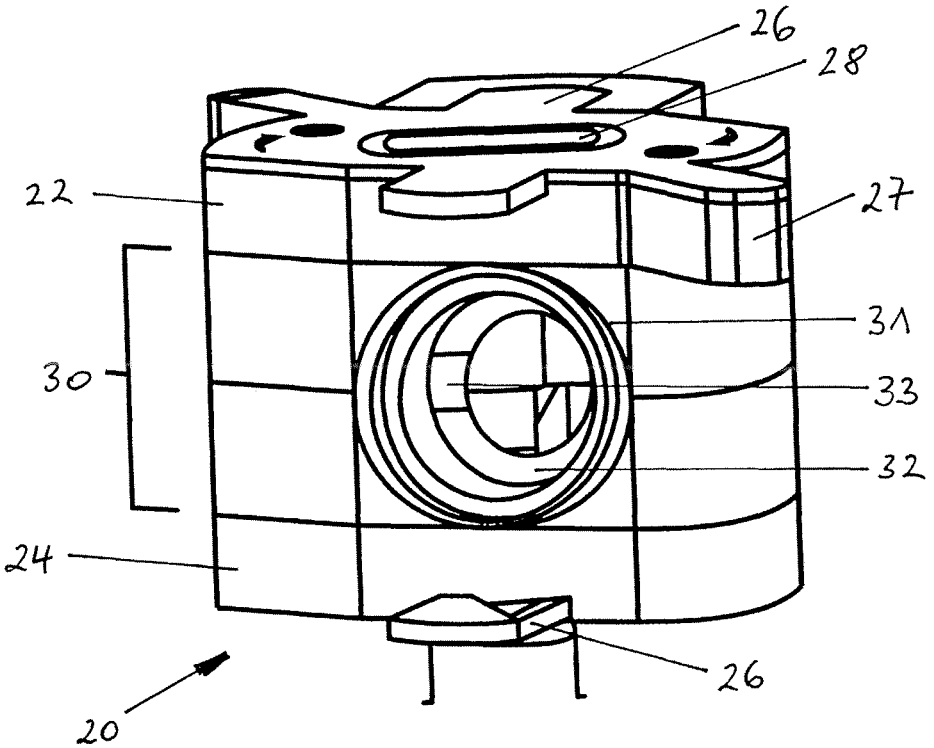
FIG. 2 shows a simplified view of a multi-part pump rotor of a fluid pump according to aspects of the embodiment in an assembled state in which pressure elements are not yet equipped.

As shown in FIG. 2, the pump rotor 20 rotatable in the fluid pump 100 is composed of the first upper cover element 22, the base 30 and a second lower cover element 24, wherein each of the cover elements 22, 24 is immovably connected to the base 30 and, respectively, fixed to the latter.

The first upper cover element 22 corresponds, as to its substantial peripheral extension, to that of the base 30, except for at least one first projection (first arm-shaped extension) 26 and one second projection (second arm-shaped extension) 27.

The first projection 26 extends in the effective direction of an occlusion force in plate shape and level or, respectively, flush with the upper surface of the first cover element 22 and protruding from the base 30. In other words, the first projection 26 is produced as plate-shaped protrusion having a smaller height than the first cover element 22 which protrudes flush with the upper surface thereof outwardly to the bearing surface 60. The number of projections 26 corresponds to the number of pressure elements 40 arranged within the fluid pump 100.

The second projection 27 is equally arranged to be flush with the upper surface of the first cover element 22 and arm-shaped in the direction of rotation ahead of the first projection 26 and having a height which can correspond to the height of the first cover element 22 and, at an appropriately predetermined length, serves for holding down a hollow conductor portion subsequently occluded by the pressure element 40 level with the pressure member 40. In other words, during operation of the fluid pump 100 the second projection 40 may slide ahead of the pressure member 40 over the surface of the hollow conductor 80 while adapting the height position of the hollow conductor 80 to the height of the pressure member 42 (of the roller) so that the latter then may roll off the surface of the hollow conductor 80 and apply the occlusion force. The number of projections 27 corresponds to the number of pressure elements 40 disposed in the fluid pump 100.

A central portion of the first cover element 22 includes an opening 28 for a cap element 29 or a cap (rotor cap) which may take, for example, an approximately rectangular shape. The cap element 29 is configured to perform or at least support force transmission from the drive shaft which is guided through the pump rotor 20 at the bottom side and is connected to the drive motor and/or the gear unit.

The base 30 includes, on the face side, at least one aperture 31 which opens into its interior for accommodating the pressure element 40 and forming a passage for the latter. In the aperture 31 a reinforcing element 32, for example a basically ring-shaped sheet metal part, is arranged to improve the capacity of maintaining the occlusion force. The reinforcing element 32 includes at least one recess 33 through which a pin-shaped securing means 46, such as a cylindrical pin, provided at the pressure element 40 can be guided and after rotation can be secured against the reinforcing element 32 and thus against release. In other words, the reinforcing element 32 is produced to be ring-shaped with the recess 33 which in operative connection with the pin-shaped securing means 46 forms a bayonet lock which allows for an assembly of the pressure element 40 via the bayonet lock and to which the pressure element 40 can be secured by passing the pin-shaped securing means 46 through the recess 33 and then rotating the pressure element 40 together with the securing means fixed thereto about 90° in the bias of the spring 45 by the spring force in the bias. In this way, the at least one pressure element or the plurality of pressure elements 40 may be assembled or preassembled into the base 30.

The second lower cover element 24 substantially also corresponds to the peripheral extension of the base 30 except for at least the first projection 26 also provided here. The second projection 27 is not required on the second cover element 24 and therefore is not provided on the same.

The first projection 26 is arranged also on the second cover element 24 in the effective direction of the occlusion force in plate or panel shape and level with the lower surface of the second cover element 24 while protruding from the base 30. In other words, the first projection 26 is manufactured as a plate-shaped projection having a smaller height than the second cover element 24 which protrudes outwardly while being flush with the lower surface thereof. The number of projections 26 corresponds, also for the second cover element 24, to the number of pressure elements 40 disposed in the fluid pump 100.

A central portion in the bottom surface of the second cover element 24 preferably includes a profile (not shown) for centering the pump rotor 20, with the profile corresponding to a profile on the drive shaft.

In the pump rotor 20 shown in FIG. 2 the second lower-side cover element 24 is configured to accommodate, by preassembly, magnets for measuring the rotational speed in the projections 26, for example, and to provide centering of the pump rotor 20 by the introduced profile corresponding to a profile on a drive shaft, and the first upper-side cover element 22 is configured to accommodate, equally by preassembly, the cap element 29 for the force transmission from the drive shaft and at least one spring (not shown) bearing against the base 30 and/or the second cover element 24.

Figure 3:
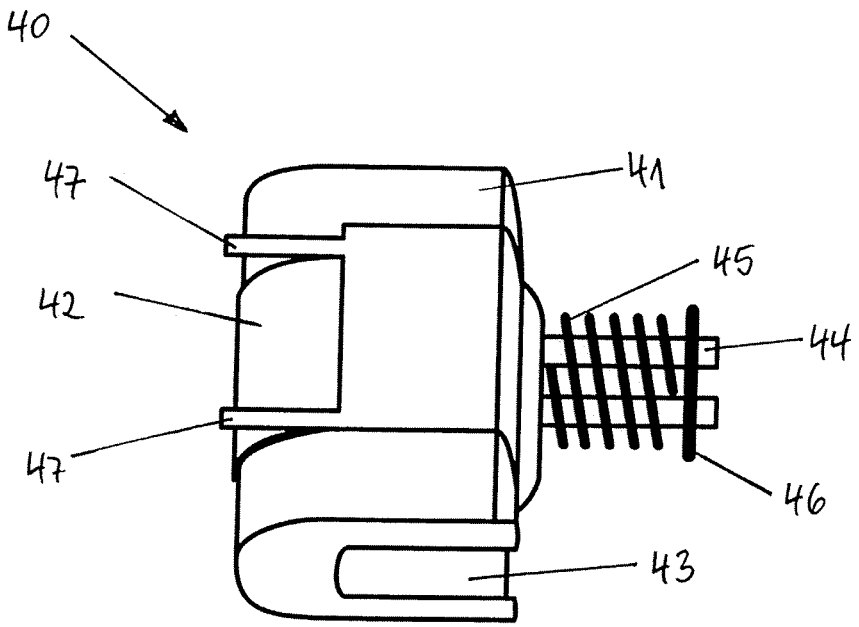
FIG. 3 shows a simplified detailed view of a pressure element according to aspects of the embodiment.

Hereinafter, with reference to FIG. 3 and FIG. 6, the pressure element 40 according to the embodiment will be described in detail. As is shown in FIG. 3, the pressure element 40 includes a multi-part, for example three-part, housing 41 the parts of which are injection-molded from plastic, for example, and are connectable with internal cylindrical pins (48 in FIG. 6).

On a front-side opening of the housing 41 the pressure member 42 is exposed toward the hollow conductor 80. The pressure member 42 is made, by the way, from an externally supported roller body or an externally supported roller such that outer bearings (49 in FIG. 6) can be retained from outside via press fits (50 in FIG. 6) in outer housing parts of the multi-part housing 41 and no spacers are required. The pressure element 42 can be preassembled by inserting and, respectively, fixing one of the bearings of the pressure member 42 in the press fit 50 of one of the housing parts and by guiding and, respectively, fixing the other housing part via the cylindrical pins 48 until the other bearing of the pressure member 42 will be located within the press fit 50 of the other housing part and is fixed therein, respectively.

Pin-shaped extensions 47 of the housing in the lateral area of the pressure member 42 are configured to provide a guideway for the hollow conductor 80 or tube so as to guide the hollow conductor 80 above the pressure member 42 and to prevent the hollow conductor from slipping off pressure member 42.

Figure 4:
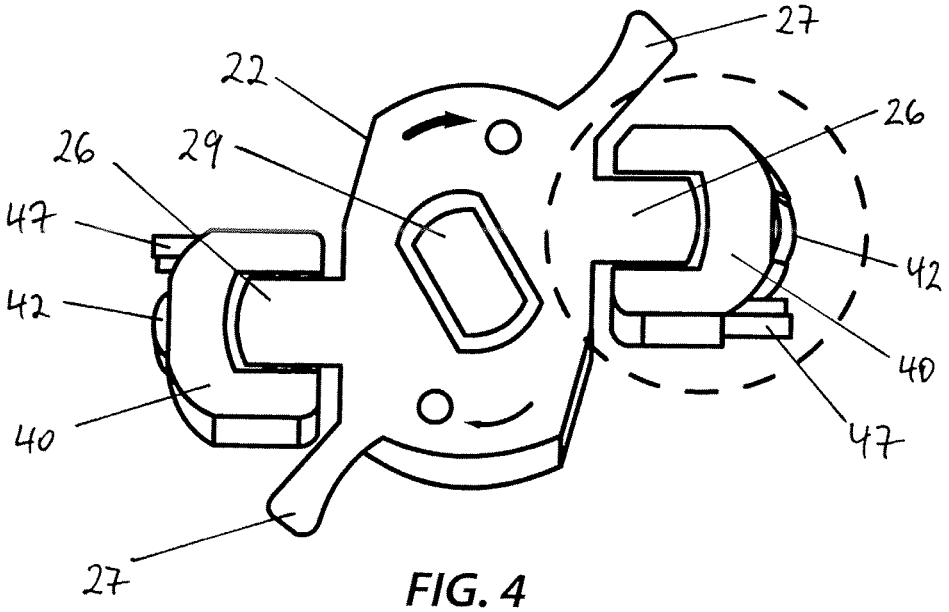
FIG. 4 shows a schematic top view onto the pump rotor including linearly guided pressure elements arranged thereon according to aspects of the embodiment.

On the rear side of the housing 41 a housing extension 44 is arranged over which a spring 45 can be slipped and can be fastened with a securing pin 46 (cylindrical pin) serving as securing means. The spring 45 may be attached at a predetermined bias and the pressure element 42 preassembled in this way may be mounted with the securing pin 46 in the bayonet lock 32, 33 in the aperture 31 of the base 30 as described before and shown in FIG. 4. The securing pin 46 can be damped with silicone, for instance, at its ends. The preassembled component moreover can be checked for observing a specified spring force, for example, prior to being mounted into the base 30.

At flanks of the housing 41 recesses 43 corresponding as to shape and size to the first projection 26 on the first and second cover elements 22, 24 are arranged on both sides.

After mounting the pressure element 40 into the base 30, i.e. after inserting the same in a first alignment into the aperture 31 of the base 30 and passing the securing pin 46 against the bias of the spring 45 through the recess 33 of the reinforcing element 32 and then fixing in this mounting position by rotating the pressure element 40 about e.g. 90°, the recesses 43 are located in parallel to the bearing faces for the first and second cover elements 22, 24 on the base 30.

When, in this partly assembled state of the pump rotor 20, the first and second cover elements 22, 24 are attached to the base 30 and connected thereto, the projections 26 of the first and second cover elements 22, 24 engage in the recesses 43 of the pressure element 40 and, when operatively connected to the same, form a linear guiding of the pressure element 40 in which the pressure element 40, on the one hand, is secured by attaching the first cover element 22 or, respectively, cover and the second cover element 24 or, respectively, bottom rotationally fixed and against falling out and, on the other hand, at the same time a longitudinal movement of the pressure element 40 is possible in a direction (direction of force) defined by the linear guiding formed by engagement of the recess 43 and the projection 26.

Figure 5:
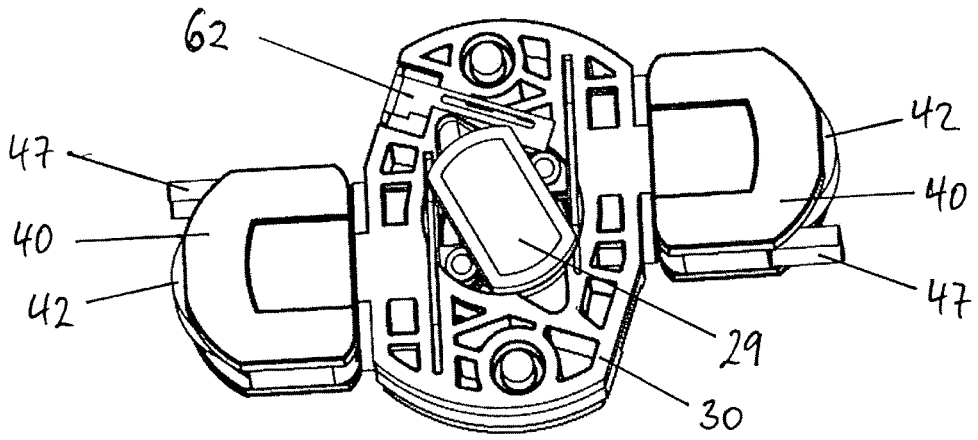
FIG. 5 shows a schematic top view onto the pump rotor according to FIG. 4 with the cover being removed according to aspects of the embodiment.

Hereinafter, bringing about a form closure between the base 30, the first cover element and the drive shaft in the pump rotor 20 will be described in detail with reference to FIG. 5 and FIG. 6. FIG. 5 illustrates a top view onto the base 30 with the first cover element 22 being removed and the cap element 29 being attached.

The partial device according to the embodiment as shown in FIG. 5 permits to mount and release the cap element 29 with a combination of a suspension 66 and a securing element 62 which can be operated e.g. by pressing and thus displacing into a recess on the base 30, for example a locking plate having a recess along a longitudinal side thereof. The cap element 29 (rotor cap) in its released position permits independent rotation of the pump rotor 20 and of the drive shaft in the type of freewheeling.

In detail, the cap element 29 is adapted to be inserted in the aperture 28 in the area of the center of the first cover element 22 and is arranged for establishing a releasably positive/non-positive connection and thus force transmission between the drive shaft and the base 30 (center part of the pump rotor 20).

The positive/non-positive connection is established by the securing element 62 which is provided to be slidingly movable on the surface of the base 30 and, at a first position (locking position) having a first width that is larger than the recess, engages in an undercut recess of the cap element 29 and, at a second position (releasing position) at which the recess is provided and the securing element 62 has a smaller width, is moved out of the undercut within the cap element 29. In this way, the cap element 29 is forced upwards by springs 66 supported against the second cover element 24 and the form closure between the cap element 29 and the drive shaft is released so that the pump rotor 20 supported on the drive shaft is freely rotatable.

Figure 6:
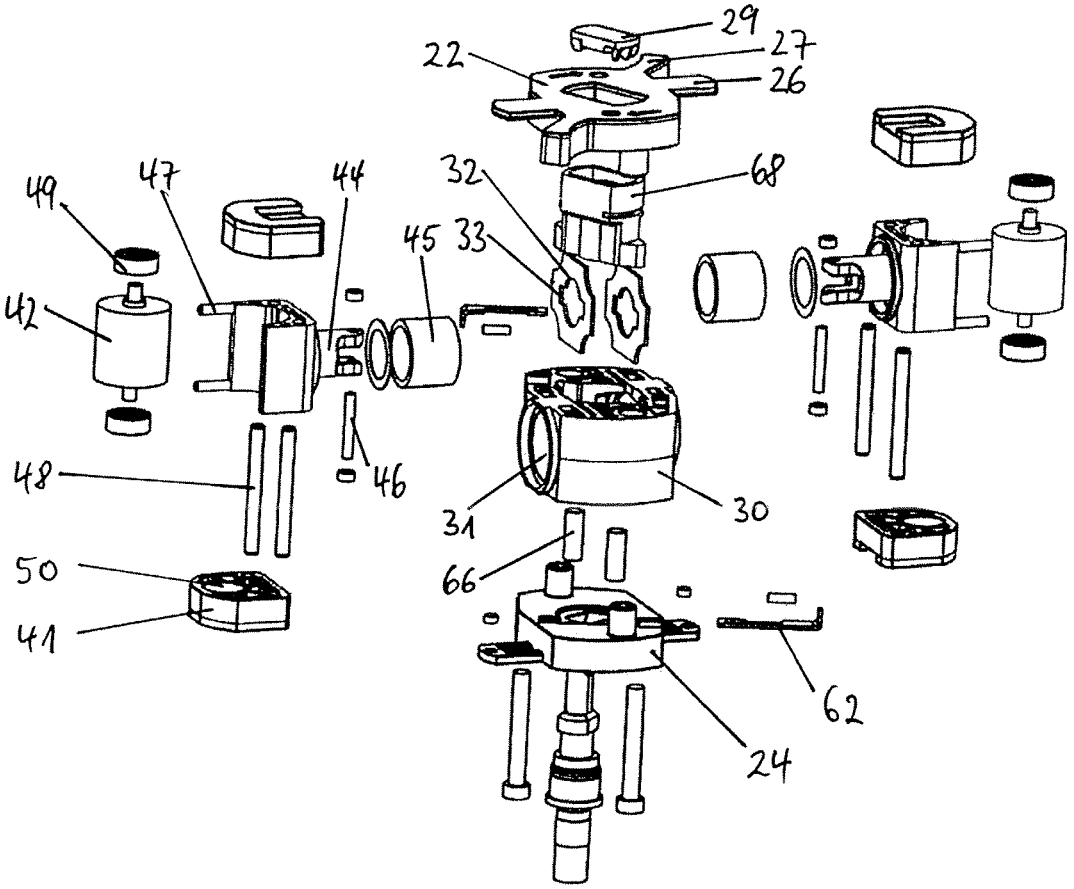
FIG. 6 shows a simplified exploded view of a configuration of the pump rotor according to aspects of the embodiment.

As shown in FIG. 6, in the present embodiment the cap element 29 is designed to be at least two-part and includes a molded part 64 having at least one driver profile section 68 along a predetermined height of the molded part 64 which in the locking position engages in a counter profile on the base 30 and drives the same by rotation and in the release position is forced upwardly to disengage from the counter profile by the spring force of the springs 66 and is freely rotatable.

The driver profile section 68 can be plug-connected on the upper side, i.e. toward the first cover element 22 (cover) to a cover part of the cap element 29. Insertion and, respectively, mounting of the driver profile section 68, of the springs 66 and of the securing element 62 may be effectuated, for instance, into or onto the base 30 prior to attaching the first cover element 22. The form closure then can be brought about after attaching the first cover element 22 by pressing down the cap element 29 and the driver profile section 68 against the spring force of the springs 66 and displacing the securing element 62 into the locking position. Alternatively, preassembly thereof to the first cover element 22 may be provided in the type of arranging the driver profile section 68 on the lower side of the first cover element 22, inserting the cover part of the cap element 29 from the upper side of the first cover element 22 into the aperture 28 thereof and establishing the form closure with the securing element 62 with subsequent insertion of the parts preassembled in this way into the base 30.

In this respect, the cap element 29 constitutes an emergency rotor cap and provides an emergency rotor function for the fluid pump, as in the unlocked state or, respectively, in the release position the pump rotor continues to be rotatable when being uncoupled from the gear unit and the drive motor.

It is noted that the base 30 is formed symmetrically, i.e. its mounting position is exchangeable relative to the first and second cover elements 22, 24. Due to these characteristics of symmetry, therefore also the second cover element 24 serving as bottom, which is analogously designed and is functionally equally acting with the first cover element 22, includes the positively engaging securing element 62 and sleeve arrangements for fastening the second cover element 24 to the base 30.

The rocker arrangement including a tilt bearing previously known from prior art is replaced with a linear guiding which does not require any additional bearings. The spring 45 is arranged directly behind the pressure member 42. The linear guiding of the pressure element 40 acts in the direction of the occlusion force. An angle (FIG. 7) of the linear guiding (angle between an occlusion point of the hollow conductor 80 and the stop of the drive shaft) is defined by determining the direction and the magnitude of force for occlusion of the hollow conductor 80 and preferably ranges from 35° to 55°, and optimally amounts to 42°.

Figure 7:
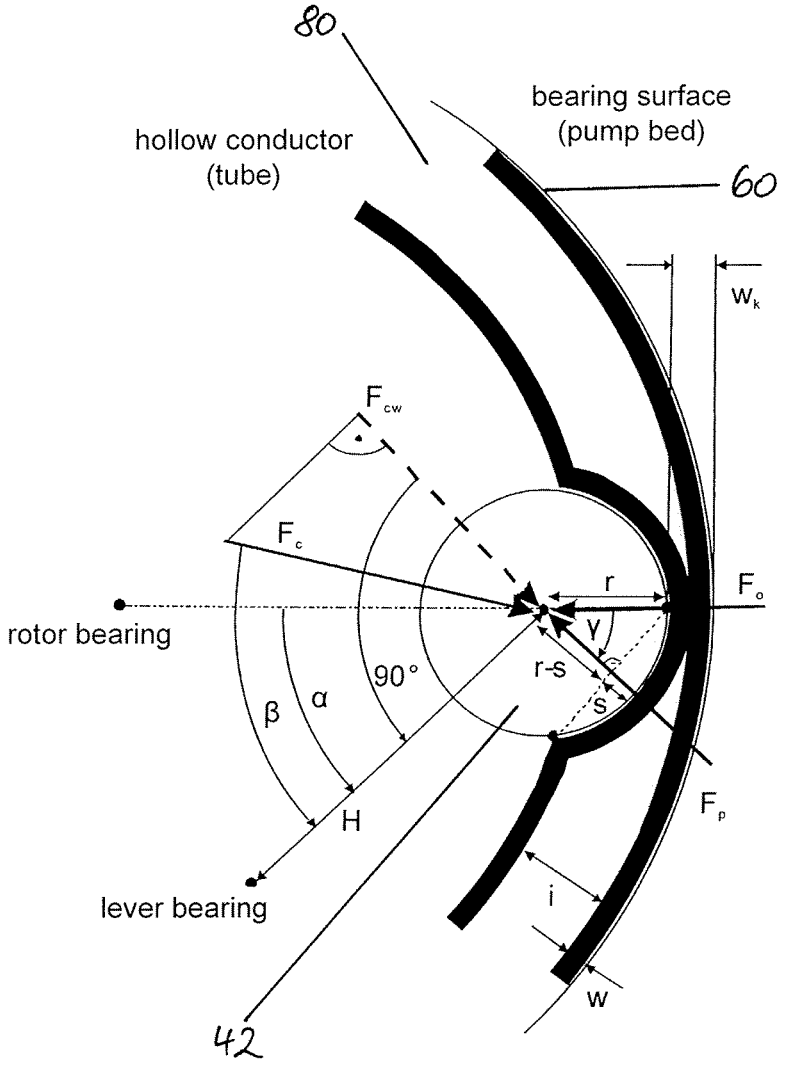
FIG. 7 shows a schematic view of a force diagram in the embodiment.

FIG. 7 shows a force diagram for illustrating forces at the occlusion point. In FIG. 7 $F_C$ is the spring force of the spring 45, $F_{CW}$ is the effective spring force perpendicularly to a lever, $F_O$ is the occlusion force and $F_P$ is the opening force for removing the occlusion due to the fluid pressure inside the hollow conductor 80 as well as the tube elasticity. The direction of force of the spring (guiding direction of the pressure element 40) at an angle of 90°-β, i.e. within a range of from 35° to 55° and optimally of 42°, angularly points against the direction of force of the occlusion of the hollow conductor 80.

As described in the foregoing, a fluid pump 100 functioning according to the principle of an occlusive peristaltic pump comprises a pump rotor 20 rotatable within the fluid pump, consisting of a base 30, a first cover element 22 fastened on the upper side of the base and a second cover element 24 fastened on the lower side of the base and comprises at least one pressure element 40 accommodated in the base having a pressure member 42 for occlusion of a fluid-guiding hollow conductor section against a rounded bearing surface 60 at a housing portion of the fluid pump 100. The at least one pressure element 40 is linearly guided in the effective direction of an occlusive force by the first cover element 22 and the second cover element 24.

In accordance with the present embodiment, the fluid pump may be a peristaltic pump of a dialysis machine comprising a linear guiding of the pressure element 40 and, respectively, the pressure member 42. The direction of force of the spring 45 (guiding direction of the pressure) angularly points against the direction of force of the occlusion of the tube. The roller-type pressure member 42 is supported via the pressure element 40 on the outside of the base 30, with the pressure member being mounted to the base 30 with a bayonet lock. The pressure element may be two-part (element member and cover part) or three-part (element member and two cover parts) and may be connectable with cylindrical pin(s). The spring 45 is arranged behind the pressure element 40 and is secured by the cylindrical pin 46. Mounting and releasing of the rotor cap 29, 68 is possible by the combination of the suspension 66 and the securing element 62, with the rotor cap 29, 68 in the released, i.e. disconnected position enables independent rotation of the pump rotor 20 in the drive shaft in the form of freewheeling. The bottom formed by the second cover element 24 is releasably fastened to the drive shaft by another securing element and is preassembled with magnets for measuring the rotational speed. A pump housing including a cover is provided. The cover of the gear unit and, respectively, the drive may simultaneously be the bearing surface of the pump rotor 20, wherein a support surface module can be mounted to the bearing surface. That is to say that the gear unit or drive and the pump rotor 20 are separated from each other by only one housing wall including the drive shaft extending through the wall. The pump rotor 20 is centered by corresponding profiles in the bottom of the pump rotor 20 and of the drive shaft. Roller bearings are retained from outside via a press fit 50.

The linear guiding may be beveled for compensating a draw, i.e. a required inclination of surfaces for removal from the tool after plastic injection molding. An additional force component occurring by such beveling may be absorbed by an appropriate bearing in the gear unit.

In order to minimize wear at the linear guiding, the latter may be designed either as profile (e.g. swallow tail). Alternatively, the contact of the pressure element with the cover and the bottom may be designed to be tilted instead of straight so as to reduce the period of friction and thus the wear as well as jamming. Preferably, friction-optimized material combinations can be used which do not promote any jamming. For example, a combination of PBT with PBT may be provided or a combination of PBT with PI+graphite+PTFE may be used as insert in the guiding.

Referring to the housing of the fluid pump 100, the bearing surface or the pump bed 60 may be separated from a bottom part for simpler and better machining, which allows to use raw material that is similar to the final geometry. A bottom plate for the housing part including the bearing surface and, respectively, the back side thereof moreover may be simultaneously configured as cover of a gear unit. Housing parts can be fitted via tapered pins and/or can be fixed by screws, wherefrom a smaller number of geometric tolerances is resulting with respect to the tolerance of the occlusion point and which allows larger tolerances to be compensated.

As an alternative, the bearing surface may be configured with the bottom plate as an injection molding, wherein the draw can be compensated by the pump rotor 20 or the draw can be removed by refinishing. In this case, too, a bottom plate may be configured for the housing part including the bearing surface and, respectively, the rear side thereof moreover may be simultaneously configured as a cover of a gear unit.

The invention claimed is:

1. An occlusive peristaltic fluid pump, comprising:

a base defining a center axis about which the base is rotatable;

a first cover element and a second cover element of the base defining a linear guide;

at least one pressure element configured to generate an occlusion force for occlusion of a hollow conductor at an occlusion point when linearly guided within the linear guide in an a guiding direction; and a pump rotor rotatable in the fluid pump, the pump rotor including the base, the base having an upper side and a lower side, the first cover element fastened to the upper side of the base and the second cover element fastened to the lower side of the base, the at least one pressure element being linearly guided in the guiding direction, the guiding direction being offset at a non-zero angle from a radial direction extending from the center axis of the base to the occlusion point, where the guiding direction and radial direction intersect at a vertex of the non-zero angle, wherein the non-zero angle is defined by a direction and a magnitude of the occlusion force, the at least one pressure element including a pressure member for occluding the hollow conductor against a rounded bearing surface on a housing portion of the fluid pump and the at least one pressure element being linearly guided with the first cover element and the second cover element producing the linear guiding, wherein the pressure member is spring-loaded by a spring enclosed in a rear housing extension and the spring is secured within the housing extension by a pin, and wherein the base includes at least one passage for the at least one pressure element and the at least one passage includes a reinforcing element, the reinforcing element having a ring shape with a recess in operative connection with the pin to form a bayonet lock to which the at least one pressure element is fastened by passing the pin through the recess and then rotating the at least one pressure element along with the pin about 90° with the spring biased by a spring force.

2. The fluid pump according to claim 1, wherein the non-zero angle of the linear guide ranges from 35° to 55°.

3. The fluid pump according to claim 2, wherein the non-zero angle of the linear guide is 42°.

4. The fluid pump according to claim 1, wherein each of the first and second cover elements includes at least one first projection protruding in the guiding direction, the at least one pressure element includes recesses on an outer housing side corresponding to the at least one first projection at each of the first and second cover elements, and the first projections on the first and second cover elements engage the recesses of the at least one pressure element on the outer housing side to form the linear guide for the pressure element.

5. The fluid pump according to claim 1, wherein the linear guide is beveled for at least one of compensating a draw, reducing a friction period, or reducing susceptibility to jamming, and/or the linear guide is configured in a predetermined profile to reduce wear.

6. The fluid pump according to claim 5, wherein the linear guide is produced using friction-optimized material combinations and wherein material combinations are PBT with PBT or PBT with PI+graphite+PTFE configured as an insert into the linear guide.

7. The fluid pump according to claim 4, wherein at least the first or second cover element includes at least one second projection protruding from the base outside the guiding directio and in the direction of rotation ahead of the pressure element, with the second projection arranged to hold down a hollow conductor portion subsequently occluded by the at least one pressure element level with the associated pressure member.

8. The fluid pump according to claim 1, wherein the pressure member is a roller-shaped element externally supported, without spacers, in the pressure element by press fits retained at an outer end side.

9. The fluid pump according to claim 1, wherein:

the base and the first and second cover elements are made from injection-moldable plastic; and a housing of the fluid pump comprises a first housing part having a portion in which a rounded bearing surface is produced and at least one second housing part comprising a bottom plate mechanically connectable to the first housing part and that is configured at its rear as at least one of a motor cover or gear unit cover, wherein the first housing part and the at least one second housing part are made from machinable material or the first housing part and the at least one second housing part are made from injection-moldable plastic.

10. An occlusive peristaltic fluid pump, comprising:

a base defining a center axis about which the base is rotatable;

a first cover element and a second cover element of the base defining a linear guide;

at least one pressure element configured to generate an occlusion force for occlusion of a hollow conductor at an occlusion point when linearly guided within the linear guide in a guiding direction; and a pump rotor rotatable in the fluid pump, the pump rotor including the base, the base having an upper side and a lower side, the first cover element fastened to the upper side of the base and the second cover element fastened to the lower side of the base, the at least one pressure element being linearly guided in the guiding direction, the guiding direction being offset at a non-zero angle from a radial direction extending from the center axis of the base to the occlusion point, where the guiding direction and radial direction intersect at a vertex of the non-zero angle, the non-zero angle defined by a direction and a magnitude of the occlusion force, the at least one pressure element including a pressure member for occluding the hollow conductor against a rounded bearing surface on a housing portion of the fluid pump and the at least one pressure element is linearly guided with the first cover element and the second cover element producing the linear guiding, wherein:

the second cover element is configured to accommodate magnets and to provide centering of the pump rotor by an incorporated profile which corresponds to a profile on a drive shaft;

the first cover element is configured to accommodate a cap element for force transmission from a drive shaft and at least one spring bearing against at least one of the base or the second cover element;

between the base and the first cover element an operable securing element is arranged which is configured, when being operated, to release the securing element spring-loaded by a spring between the base and the first cover element; and the first and second cover elements are configured to secure the at least one pressure element fixedly to the base.

* * * * *